US005657935A

United States Patent [19]

Cooper

[11] Patent Number: 5,657,935

[45] Date of Patent: Aug. 19, 1997

[54] WIRE DISPENSER WITH ADJUSTABLE BASE

[75] Inventor: Edward L. Cooper, Clarklake, Mich.

[73] Assignee: Elco Enterprises, Inc., Clarklake, Mich.

[21] Appl. No.: 568,783

[22] Filed: Dec. 7, 1995

[51] Int. Cl.[6] ..... B65H 49/00; B65H 18/26; B65H 59/00

[52] U.S. Cl. ..... 242/128; 242/147 R; 242/156.2; 242/416; 242/566; 403/374; 403/DIG. 8

[58] Field of Search ..... 242/128, 156.2, 242/147 R, 171, 416, 423.1, 566; 403/22, 374, DIG. 8

[56] References Cited

U.S. PATENT DOCUMENTS

| | | | |
|---|---|---|---|
| 1,097,185 | 5/1914 | Oehrle | 403/DIG. 8 X |
| 1,920,962 | 8/1933 | Arkema | 242/128 |
| 2,319,828 | 5/1943 | Rohweder | 242/128 |
| 3,618,873 | 11/1971 | Fons et al. | 242/128 |
| 3,997,127 | 12/1976 | Kovaleski | 242/128 |
| 4,017,037 | 4/1977 | Kovaleski | 242/128 X |
| 4,206,889 | 6/1980 | Adelhardt et al. | 242/128 |
| 4,253,624 | 3/1981 | Colbert | 242/128 |
| 4,435,105 | 3/1984 | Rampley | 403/109 |
| 4,657,204 | 4/1987 | Colbert | 242/128 |
| 4,681,277 | 7/1987 | Kosch | 242/128 X |
| 5,007,597 | 4/1991 | Jones | 242/128 X |
| 5,465,917 | 11/1995 | Kosch | 242/128 |

*Primary Examiner*—Michael Mansen
*Attorney, Agent, or Firm*—Duncan F. Beaman

[57] ABSTRACT

A wire dispenser for dispensing coiled wire, such as welding wire, wherein the dispenser uses a wire guiding arm which rotates about the spool upper flange. The wire guide arm is mounted upon a vertical column supported by the spool end flange through a base plate concentrically located upon the spool flange. Selectively usable mounting structure defined on the base plate permits the dispenser to be used with spool end flanges having different sizes of hole dimensions and a cam type locking detent mounted upon the base plate firmly locks the base plate with respect to the spool flange. The wire guiding structure mounted upon the column includes a flexible tube permitting the wire guide to be most efficiently related to various sizes of wire coils and an adjustable arm supporting the flexible tube permits operators of ordinary skill to readily accommodate the dispenser to various sizes of spools.

16 Claims, 2 Drawing Sheets

WIRE DISPENSER WITH ADJUSTABLE BASE

BACKGROUND OF THE INVENTION

1. Field of the Invention

The invention pertains to wire dispensers of the rotating type for dispensing spooled coiled wire, such as welding wire, wherein the dispenser may be accommodated to various sizes and types of wire spools.

2. Description of the Related Art

Arc welding equipment of the wire type usually utilizes a wire dispenser for removing the wire from the spooled coil in such a manner as to prevent tangling of the wire. Such apparatus usually includes a vertically disposed column upon which a wire receiving guide or tube is mounted capable of rotating about the spool axis. Rotation of the arm is produced by the tension within the wire as it is fed into the welder, and a brake is usually utilized to control the rate of guide arm rotation to prevent over-running and excessive wire uncoiling. Examples of this type of wire dispenser are shown in U.S. Pat. Nos. 1,920,962; 3,618,873; 4,206,889; 4,253,624 and 4,657,204.

While it is known to mount the wire dispensing apparatus on the wire spool, the size and configuration of the central hole in the end flanges of wire spools differs between manufacturers of welding wire and it is necessary to use a dispenser specifically constructed for use with a particular manufacturer's spool. Dispensers capable of being effectively mounted upon a variety of types and sizes of wire spool end flanges have not been available.

Further, as wire spools are used several times, the size of the end flange hole may wear and increase due to its use in supporting a wire dispenser, and it is unacceptable to mount a dispenser on a spool end flange in a loose manner such as would permit the dispenser base plate to rotate on the end flange or wobble. In my co-pending application Ser. No. 08/401,153, filed Mar. 9, 1995, I have proposed a cam lock for locking dispenser end plates into worn spool end flange openings, but the apparatus shown in my earlier application is only usable with a particular size of spool flange hole.

Further, because the diameter of spool end flanges varies between manufacturers and sizes of wire spools, previous dispensing apparatus has not been suitably adjustable to accommodate various sizes of wire spools resulting in uneven wire dispensing and casting of the dispensed wire, i.e. causing a twist to occur in the wire during dispensing, and apparatus has not been previously available to permit optimum wire dispensing with a wide variety of spool sizes.

OBJECTS OF THE INVENTION

It is an object of the invention to provide a wire dispenser for coiled wire wherein the dispenser may be mounted upon spool end flanges having various sizes of central holes wherein the dispenser may be readily adapted for use with different types of spool end flanges.

Another object of the invention is to provide a wire dispenser for coiled wire wherein the dispenser may be used with several types of spool end flange mounting systems, and wherein locking detent structure utilizing a cam is adjustable to increase the frictional engagement between the dispenser and the associated wire spool end flange.

Yet another object of the invention is to provide a wire dispenser for spooled wire wherein wire being received from the spool is fed into a flexible tube which is of a configuration as related to the spool to minimize wire twist and wire casting problems.

A further object of the invention is to provide a wire dispenser for spooled wire wherein the wire is received within a flexible tube supported upon an adjustable arm wherein the arm length may be varied to position the tube with respect to the wire spool flange to produce optimum dispensing characteristics.

An additional object of the invention is to provide a wire dispenser for spooled wire utilizing a friction brake to control the dispensing guide arm rotation wherein the friction of the brake may be readily manually adjusted without special tools, and while the dispenser is mounted upon the associated spool flange.

SUMMARY OF THE INVENTION

Welding wire is wound, shipped and sold on spools having circular end flanges. The wire dispenser of the invention is supported upon the end flange of a wire spool when the spool is supported upon its end such that the spool axis is vertically oriented. Typically, the spool end flange includes a central hole, and the wire dispenser in accord with the invention includes a base plate concentrically related to the flange hole having structure extending from the base plate inner side which coaxially relates the vertical axis of the base plate to the spool axis.

The dispenser includes a vertically extending column which is centrally rotatably supported on the base plate, and the wire receiving and guiding structure is mounted upon this column.

The wire guide includes a laterally flexible tube having a lower end extending around and below the spool upper end flange to receive the wire from the spool. The flexible tube upper end is located near the upper region of the column and feeds the dispensed wire into a conveying system whereby the wire may be guided to the arc welder. The flexible tube is supported in its desired location by a support arm mounted upon the column. The support arm consists of a pair of telescoping tubes whereby the length of the support arm may be varied as desired by the use of a cotter pin, and the outer end of the arm supports an arcuate shaped cradle in the form of a tubular conduit through which the flexible tube extends.

The vertical plane of the arcuate cradle is coincidence with a vertical plane in which the vertical column lies insuring that the wire passing through the upper portion of the flexible tube will lie in this plane. Also, by making the cradle of an arc of approximately fifteen inches radius, the flexible tube will, likewise, be shaped in such a radius as it passes around the spool flange at the maximum radial dimension of the flexible tube from the axis of column rotation, and these features eliminate wire cast, twisting and kinking problems.

The base plate includes structure for cooperating with the spool end flange central hole to permit the base plate to be concentrically mounted upon flange holes of various diameter. A cylindrical boss concentrically extends from the base plate coaxial with the column, and the diameter of this boss is such as to permit the boss to be firmly received within the smallest end flange hole with which the dispenser will be used. Such end flanges also include a drive hole radially spaced from the central hole, and the base plate includes a locking detent extending from its inner side received within the flange locking hole which prevents relative rotation between the base plate and the spool end flange. The detent includes a rotatable cam wherein rotation of the cam laterally displaces the base plate in a horizontal direction forcing the boss in tight high frictional engagement with a worn central opening to provide a firm mounting of the dispenser on the end flange even though the flange hole may be worn and has become over-size.

The base plate also includes a pair of holes wherein elongated studs may be mounted upon the base plate extending from the inner side thereof. These holes and studs are equally spaced from the base plate axis, and the locking detent is located in a radially disposed slot which permits the detent to be radially adjusted and positioned. Thereupon, upon the studs being mounted upon the underside of the base plate, the two studs and the locking detent will be received within a spool end flange hole of larger diameter than that of the previously described boss, such as is used with some types of spools, and by rotating the locking detent forcing the cam against the hole periphery, the studs are forced against the hole periphery to firmly affix the base plate to an end flange having a large circular opening.

On its upper side, a friction brake is mounted which rotates with the vertical column. The friction brake includes a friction material engaging the plate upper side, and an adjustable compression spring located at the lower end of the column biases the column downwardly. An adjustable brake nut threaded upon the column engages the upper side of a brake disc, and by adjusting the vertical location of the adjusting nut the biasing force between the friction brake disc and the base plate can be adjusted. A lock nut also threaded on the column locks the adjusting nut in the desired location. As the adjusting nut and the lock nut are mounted upon the upper side of the base plate, they may be readily adjusted by the operator while the dispenser is mounted upon the spool end flange.

The aforementioned features provide a wire dispenser capable of accommodating itself to various sizes of wire spool end flanges and flange holes, permits the dispenser wire receiving tube to be adjusted to accommodate spools of various diameter while providing optimum dispensing characteristics, and the braking characteristics may be readily adjusted without removing the dispenser from the spool flange. All of these features permit operators of normal skill to install and adjust the dispenser.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
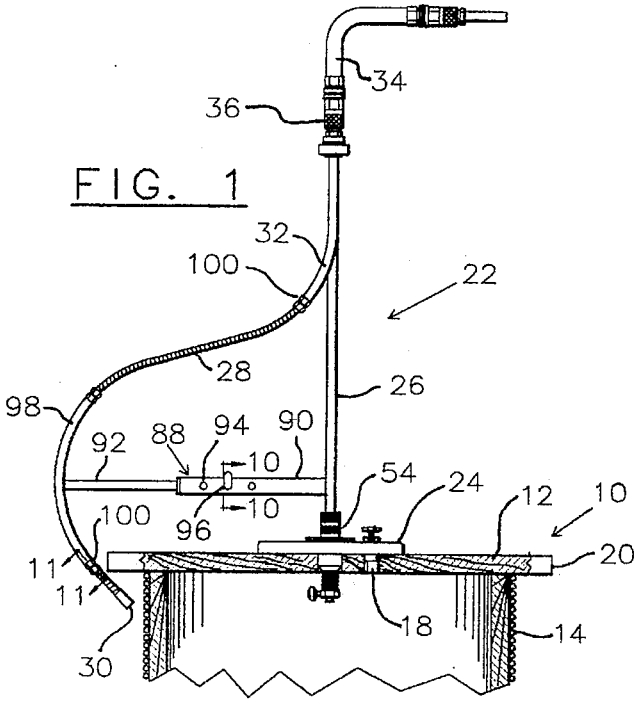
FIG. 1 is an elevational view, partially sectioned, of a wire dispenser in accord with the invention as used with a spool end flange hole of minimum diameter.

With reference to the drawings, a typical spool upon which wire is wound, such as welding wire, is generally indicated at 10, the spool including a pair of end flanges 12, only the upper end flange being shown in the drawings, and the wire 14 is tightly wound upon the spool hub. The end flange 12 includes a central circular flange hole 16, and a flange drive hole 18 of a smaller diameter than hole 16 is radially spaced from the hole 16 extending through the end flange. The end flange periphery is indicated at 20 and is usually of a circular configuration.

The aforedescribed configuration of spool 10 utilizing the flange holes 16 and 18 is typical of several wire manufacturers including National Standard Company, a major wire distributor. However, as will be later apparent, not all wire spool end flanges have a central hole of the same diameter as the hole 16, or utilize an offset hole such as at 18.

The wire dispenser utilizing the concepts of the invention is generally indicated at 22, and includes a base plate 24 which engages the end flange 12 and a column 26 extends upwardly from the base plate 24 coaxial with the spool axis and hole 16. The wire guide tube 28 is mounted upon the column 26 and includes an inlet 30 into which the wire 14 is received. The wire guiding structure includes a rigid transition tube 32 mounted upon the column 26, and the upper end of the transition tube 32 is connected to an elbow 34 of the wire distribution system by a rotatable connection 36.

The column 26 is rotatably mounted upon and extends through the base plate 24 and the lower end of the column includes threads 38. The column extends through a central hole in the base plate 24 and the lower end of the column includes the stem 40 which is threaded at 42 for receiving the spring adjustment nut 44. The compression spring 46 engages the nut 44 and a thumb lock 48 threaded into the nut 44 prevents inadvertent rotation of the nut on the column stem 40.

Braking structure for the wire guide tube 28 is mounted on the column 26 and includes a circular metal brake disc 50 through which the column lower end extends. The column lower end includes flats cooperating with a corresponding configuration in the brake disc central hole whereby the brake disc 50 and the column 26 are keyed together torquewise, but the brake disc 50 is capable of axial displacement on the column.

A fiber disc 52 is interposed between the brake disc 50 and the outer surface of the base plate 24, and an adjustment nut 54 threaded upon the column threads 38 axially locates the brake disc 50 with respect to the column. A locking nut 56 threaded upon threads 38 engages the nut 54, and once the desired position of the nut 54 is achieved, the nut 56 is tightened into engagement with the nut 54 to lock the adjustment. Preferably, the nuts 54 and 56 are exteriorly knurled to facilitate manual rotation.

Figure 2:
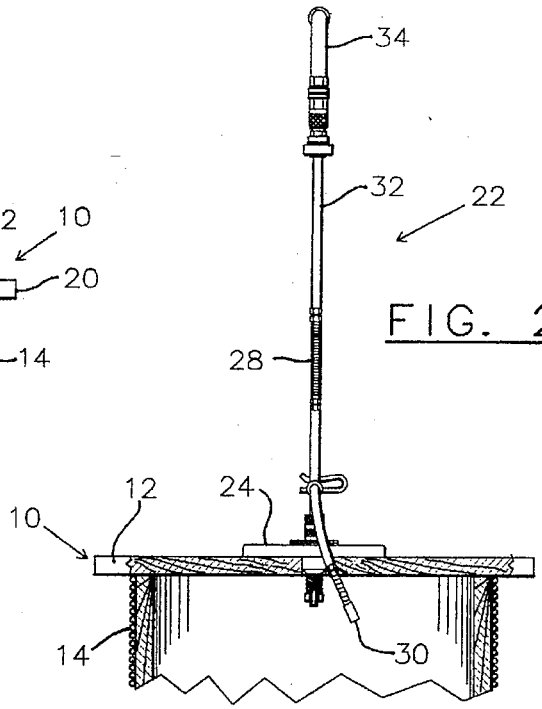
FIG. 2 is an elevational view, partially sectioned, of the wire dispenser of FIG. 1 as taken from the left of FIG. 1.
Figure 3:
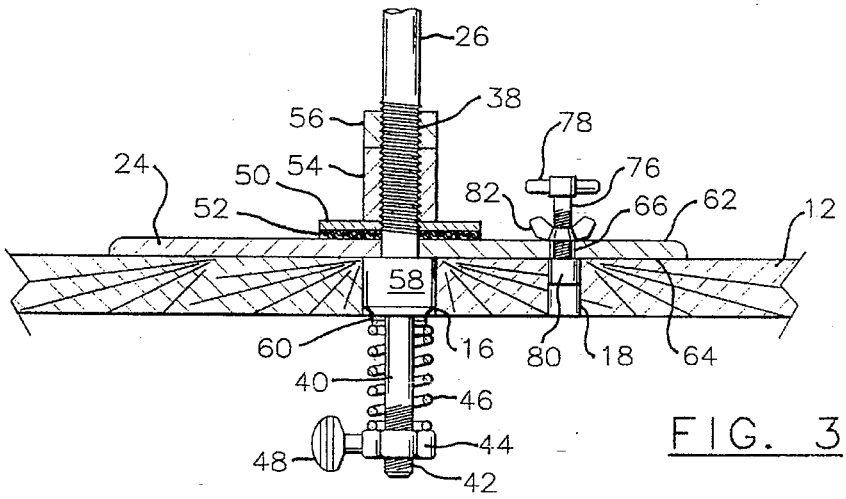
FIG. 3 is an enlarged detail elevational sectional view of the base plate and associated structure of the wire dispenser of FIGS. 1 and 2.

A cylindrical boss 58 is fixed to the base plate inner surface concentric to the base plate and the column 26. The boss 58 includes a bearing hole through which the lower end of the column extends, and the diameter of the boss 58 is slightly less than the diameter of the flange hole 16 shown in FIGS. 1–3 wherein the boss may be snugly received within the hole 16.

Art annular brass or bronze thrust bearing washer 60 engages the underside of the boss 58 through which the column extends and a steel washer is located below the thrust bearing washer 60. The spring 46 engages the steel washer, and as the lower end of the spring 46 bears against the nut 44, the spring will bias the column 26 downwardly and fine adjustment of the frictional engagement between the fiber disc 52 and the base plate outer surface 62 is adjusted by nut 54, while adjustment of the column nut 44 will permit a rough or pre-set compression of the spring 46 to control the approximate desired braking characteristics of the rotation of the column 26 during wire dispensing.

Figure 9:
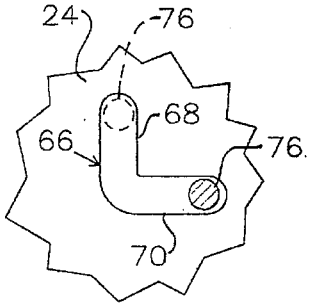
FIG. 9 is a plan sectional view of the locking detent slot as taken along Section 9—9 of FIG. 8.

The base plate 24 includes inner surface 64, and the base plate outer and inner surfaces 62 and 64, respectively, are intersected by a slot 66, FIG. 9, which includes a radial portion 68 and a tangential portion 70. The radial portion 68 is substantially radially disposed to the axis of the base plate and column 26, while the portion 70 is substantially at right angles to the portion 68.

The base plate 24 is also provided with a pair of threaded stud holes 72, FIG. 5, which are located at equal radial distances from the axis of the base plate and column which serve to mount the base plate studs through their bolts as later described. The holes 72 are spaced from each other approximately 120° in a circumferential direction with respect to the column axis.

Base plate 24 is provided with a lock detent which includes a vertically oriented threaded shaft 76 having a handle 78 located at its upper end spaced from the base plate outer surface 62. The lower end of the shaft 76 includes an eccentric cam 80 affixed thereto which extends below the base plate inner surface 64 and the cam 80 is of a generally cylindrical exterior configuration whose axis is eccentrically located with respect to the axis of the shaft 76. A wing nut 82 is threaded upon shaft 76 for engaging the base plate outer surface 62 as later described.

The shaft 76 extends through the slot 66 and may be selectively positioned in either the portions 68 or 70 as described below.

When the base plate 24 is to be mounted upon a spool end flange having a large central opening, cylindrical studs 84 are attached to the base plate as to extend from the inner surface 64. The studs 84 are mounted to the base plate by bolts 86 longitudinally extending through the studs and threaded into the stud holes 72 and are knurled to increase the frictional contact with the flange hole periphery.

Figure 10:
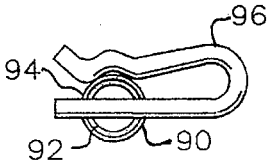
FIG. 10 is a detail elevational sectional view as taken along Section 10—10 of FIG. 1.

The wire guide 28 consists of a spiral wound tube through which the welding wire 14 extends, and is guided. The wire guide tube 28 is formed by coiled wire having adjacent contiguous spirals, and this configuration and construction of the wire guide permits the wire guide to be laterally flexible while maintaining the original length. The flexible wire guide 28 is supported by an arm 88 radially extending from the column 26 as will be appreciated from FIG. 1. The length of arm 88 is adjustable in that the inner tubular section 90 receives the outer tubular section 92 in a telescoping manner. Diametrical holes 94 defined in the sections 90 and 92 permit a cotter pin 96, FIG. 10, to be inserted in aligned holes 94 permitting the length of the arm 88 to be adjusted as desired.

Figure 8:
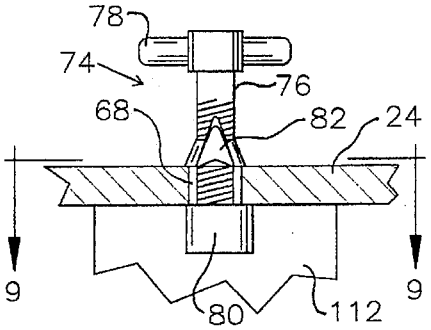
FIG. 8 is an enlarged detail elevational sectional view of the detent cam lock as taken along Section 8—8 of FIG. 6.
Figure 11:
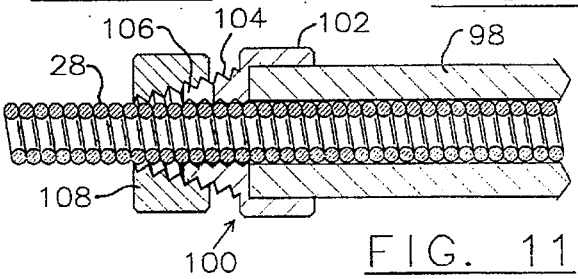
FIG. 11 is an enlarged detail elevational view as taken along Section 11—11 of FIG. 1.

The outer end of the section 92 supports a cradle conduit 98 in which the flexible wire guide 28 is loosely received. The conduit 98 is of an arcuate form as will be appreciated from FIG. 8 and, preferably, is of a generally circular configuration from the perspective of FIG. 1 having a radius of approximately fifteen inches. This dimensional configuration has proven to be very effective in controlling the twist and cast of the wire 14 as it is dispensed. The cradle 98 is generally planar and, preferably, lies in a plane coincident with a plane containing column 26. A collet connector 100 is preferably mounted on the lower end of the conduit 98 for gripping the wire guide tube, and a similar collet connector is used at the lower end of the transition tube 32. The collet connectors include a collet portion 102, FIG. 11, which is soldered or brazed to the end of the associated cradle conduit or transition tube, and the collet 102 includes conical threads 104 which are radially slit at 106 whereby threading of the nut 108 on the threads 104 will compress the threads 104 due to the conical tapered threaded hole in the nut 108, and the slits 106 permit the collet 102 to be compressed upon the wire guide tube 28 establishing a firm mechanical connection therewith without crushing or otherwise damaging the spiral tube.

Figure 5:
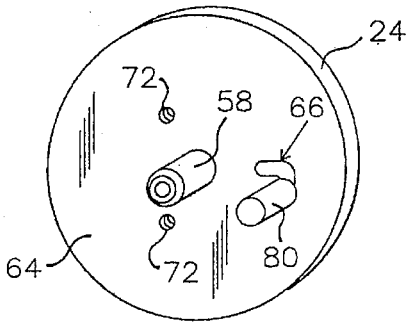
FIG. 5 is a perspective view of the base plate, per se, as prepared for use with a spool end flange having a minimum diameter central hole.

When using the dispenser 22 with a spool 10 having a minimum diameter flange hole 16, no studs 84 will be mounted to the base plate inner surface 64, and only the boss 58 and the cam 80 will be extending downwardly from the base plate inner surface as shown in FIG. 5. In this instance, the locking detent shaft 76 will be located within the slot portion 70 as shown in full lines in FIG. 9, and the distance of the slot portion 70 from the column axis is such as to locate the cam 80 so as to be readily received within the spool flange hole 18 when the boss 58 is received within flange hole 16. It will be appreciated that upon rotation of the shaft 76 by handle 78, the cam 80 will engage the outer portions of the hole 18 and rotation of the cam 80 will force the boss 58 firmly against the periphery of the flange hole 16 so as to establish a firm high frictional engagement between the base plate 24 and the end flange 12. Upon the shaft 76 being "tightened", the wing nut 82 will be rotated to firmly engage the base plate outer surface 62 preventing rotation of the shaft 76 in that the cam 80 has now been drawn up tight against the base plate inner surface 64, and the base plate will be firmly locked to the spool flange.

The length of the column arm 88 will be adjusted by aligning the arm holes 94 to position the cradle conduit 98, wire guide tube 28 and the tube inlet 30 as desired with respect to the spooled wire 14. The length of the arm 88 will be determined by the size of the spool 10 and the diameter of the end flange 12 wherein the wire dispenser tube will extend around the periphery of the end flange and the wire guide tube inlet 30 will usually be located "under" the end flange. By use of the adjustable arm 88, the wire guide tube 28 can be optimally adjusted to the spool 10 regardless of its size facilitating removal of the wire during dispensing.

The consumer of the wire 14, a welder in the event that the wire 14 is welding wire, not shown, pulls the wire 14 through the wire guide 28 in the well known manner. This action causes the wire guide 28 to rotate about the spool 10 rotating the column 26 as the wire is pulled through the guide 28. Upon cessation of wire movement through the guide, rotation of the wire guide and column will cease, and in order to control wire dispensing and not permit an excessive amount of wire to be unwound from the spool when the wire tension is abruptly terminated the friction imposed upon the column 26 by the engagement of the brake fiber disc 52 with the base plate outer surface 62 will prevent undesirable "over running" of the dispenser. As described above, the characteristics of the brake can be easily adjusted by manual rotation of the adjustment nut 54, whose position is fixed by the lock nut 56.

Figure 4:
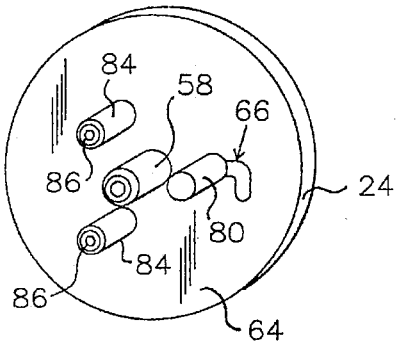
FIG. 4 is a perspective view of the inner side of the base plate, per se, illustrating the studs in place, and the locking detent being located for use with a spool end flange having a large central hole defined therein.
Figure 6:
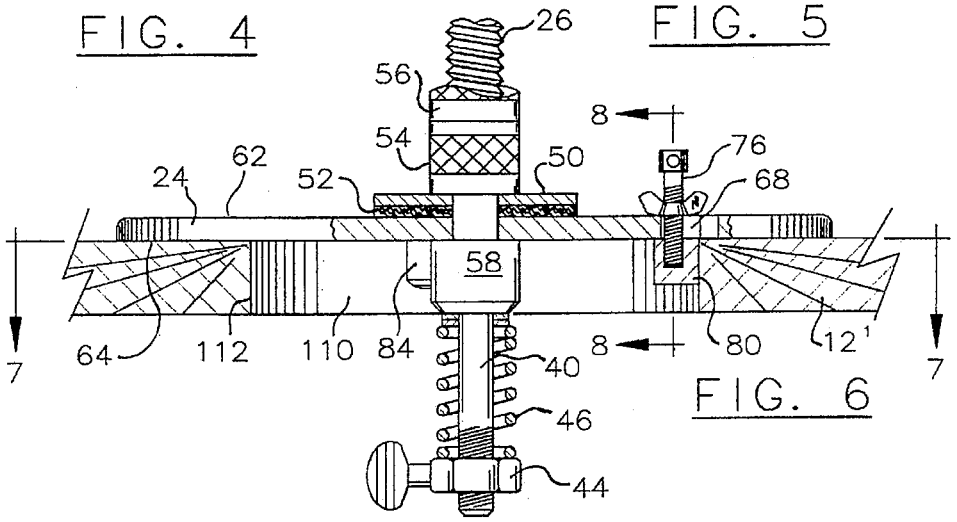
FIG. 6 is an enlarged detail elevational view, partially sectioned, illustrating the base plate as used with a spool end flange having a large diameter central hole.
Figure 7:
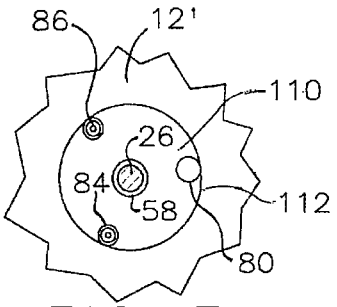
FIG. 7 is a plan sectional view taken along Section 7—7 of FIG. 6.

If it is desired to use the dispenser 22 with a spool having a large diameter hole 110 as shown in FIG. 6, the studs 84 will be mounted to the inner surface 64 of the base plate 24 by threading the bolts 86 into the holes 72. As will be appreciated from FIGS. 4 and 7, the studs 84 and the cam 80 are all disposed approximately 120° to each other about the axis of the column, and the shaft 76 will be located within the slot portion 68 adjacent the inner end thereof. As will be appreciated from FIG. 7, the studs 84 are disposed adjacent the periphery 112 of the hole 110, as is the cam 80, and by rotating the shaft 76, the studs 84 are forced into engagement with the hole periphery 112, and the frictional engagement of the cam 80 and the studs 84 will firmly affix the dispenser 22 to an end flange 12' having the enlarged hole 110. Tightening of the wing nut 82 will lock the shaft 76 against rotation once the desired frictional contact with the periphery 112 is achieved.

From the above, it will be appreciated that the wire dispenser of the invention is very flexible in its use in that it permits the wire dispenser to be quickly mounted upon spool end flanges having either small or large central holes. Further, the adjustability of the column arm 88 permits the guide tube 28 to be optimally positioned with respect to the diameter of a particular spool. The configuration of the cradle conduit 98 maintains the wire guide tube 28 in the most desirable configuration for effective wire dispensing without twisting, kinking or producing wire casting problems, and as the cradle conduit 98 maintains the wire guide 28 in a vertical plane in which the column 26 is also located as will be appreciated from FIG. 2, optimum wire dispensing characteristics are achieved with a minimum of wire handling problems.

It is appreciated that various modifications to the inventive concepts may be apparent to those skilled in the art without departing from the spirit and scope of the invention.

I claim:

1. A dispenser for wire coiled upon spools having end flanges having a central circular hole wherein different spools have holes of different diameter defined therein each having a periphery comprising, in combination, a base plate having an axis and inner and outer sides, a column mounted on said base plate coaxially extending from said outer side, a wire receiving guide mounted upon said column adapted to rotate about the associated spool flange, first and second end flange hole alignment means defined on said base plate selectively cooperating with the flange hole, said first and second hole alignment means being selectively used to extend from said base inner side to mount said base plate upon the associated spool end flange in accordance with the end flange hole diameter, and locking means mounted on said base plate extending from said inner side radially adjustable with respect to said base plate axis to lock the selected alignment means within the associated spool end flange.

2. In a dispenser for wire as in claim 1, said first alignment means comprising a cylindrical boss extending from said base plate having an axis coincident with said base plate axis.

3. In a dispenser for wire as in claim 1, said second alignment means including stud holes defined in said base plate for each selectively receiving an elongated stud adapted to extend from said base plate inner side to engage the spool hole periphery, said stud holes being equally spaced from said base plate axis.

4. In a dispenser for wire as in claim 1, said locking means including a slot defined in said base plate having a radial portion radially disposed to said base plate axis, and a radially adjustable detent mounted in said slot extending from base plate inner side.

5. In a dispenser for wire as in claim 4, said slot including a lateral portion transversely related to said radial portion, said detent including an eccentric cam surface whereby rotation of said detent about an axis substantially parallel to said base plate axis varies the radial dimension between said base plate axis and the detent portion furthest from said base plate axis.

6. A dispenser for wire coiled upon a spool having an axis, an end flange having a first central hole concentric to the axis and a second hole radially spaced from the first hole comprising, in combination, a base plate having an axis and inner and outer sides, an elongated column mounted of said base plate coaxially extending from said outer side, a wire receiving guide mounted upon said column adapted to rotate about the spool flange, a boss having an axis coincident with said base plate axis and a configuration corresponding to that of the flange central hole for reception therein mounted on said base plate extending from said inner side, and a detent mounted on said base plate radially spaced from said base plate axis radially adjustable with respect to said base plate axis and extending from said inner side for reception into the flange second hole preventing rotation of said base plate relative to the spaced flange.

7. In a dispenser for wire as in claim 6, said detent including a rotatable shaft having an axis parallel to said base plate axis extending through said base plate, an eccentric cam mounted on said shaft receivable within the flange second hole, and a shaft lock mounted on said shaft selectively preventing rotation thereof.

8. A dispenser for wire coiled upon a spool including an end flange having a central circular hole defined therein having a periphery comprising, in combination, a base plate having an axis and inner and outer sides, a column mounted on said base plate coaxially extending from said outer side, a wire receiving guide mounted upon said column adapted to rotate about the spool flange, at least three spaced projections mounted on said base plate extending from said inner side adapted to be received within the flange central hole for engagement with the periphery thereof, at least two of said projections being equally spaced from said base plate axis, and adjustment means mounting the other of said projections for radial adjustment relative to said base plate axis.

9. In a dispenser for wire as in claim 8, said other of said projections comprising a rotatable shaft having an axis parallel to said base plate axis extending through said base plate, an eccentric cam mounted on said shaft adapted to engage the flange hole periphery, and a shaft lock mounted on said shaft selectively preventing rotation thereof.

10. A dispenser for wire coiled upon a spool including an end flange having a central circular hole defined therein having a periphery comprising, in combination, a base plate having an axis and inner and outer sides, a column mounted on said base plate coaxially extending from said outer side, a wire receiving guide mounted upon said column adapted to rotate about the spool flange, means defined on said base plate for mounting said base plate upon a spool end flange, said wire guide including a laterally flexible tube comprising contiguous spiral coils having a lower wire receiving end and an upper wire dispensing end and an elongated tube support arm having an inner end mounted on said column and an arcuate flexible tube cradle defined on said outer end supporting and shaping only the portion of said tube intermediate said tube ends furthest from said column.

11. In a dispenser for wire as in claim 10, said cradle comprising a rigid arcuate conduit receiving a portion of said tube, said conduit and said column being located within the same plane whereby the portions of said flexible tube between said conduit and its upper end will lie within said plane.

12. In a dispenser for wire as in claim 11, said conduit, and the flexible tube thereon having a radius of approximately fifteen inches.

13. In a dispenser for wire as in claim 10, said support arm including adjustable means whereby said arm is adjustable in length.

14. In a dispenser for wire as in claim 13, said support arm adjustable means, including first and second telescoping portions, and locking means selectively interconnecting said telescoping portions.

15. In a dispenser for wire as in claim 13, said support arm including telescoping portions, and locking means selectively interconnecting said telescoping portions.

16. A dispenser for wire coiled upon a spool including an end flange having a central circular hole defined therein having a periphery comprising, in combination, a base plate having an axis, an inner side, and an exteriorly accessible outer side, a column rotatably mounted on said base plate coaxially extending from said outer side, a wire receiving guide mounted upon said column adapted to rotate about the spool flange, flange hole alignment means defined on said base plate, locking means mounted on said base plate extending from said inner side adapted to lock said base plate upon the end flange preventing relative rotation between said base plate and the spool end flange, friction brake means interposed between said column and said base plate outer side frictionally resisting rotation of said column and wire receiving guide upon said base plate, and brake adjustment means mounted on said column including a nut threaded upon said column engaging said brake means selectively adjusting the frictional braking characteristics of said brake means whereby such frictional characteristics may be adjusted without disassembling said base plate from the spool end flange.

* * * * *